US012383067B2

(12) United States Patent
Ge

(10) Patent No.: US 12,383,067 B2
(45) Date of Patent: Aug. 12, 2025

(54) TRAVEL PILLOW

(71) Applicant: Ningbo Usun Products Design Co., Ltd., Ningbo (CN)

(72) Inventor: Wenguo Ge, Ningbo (CN)

(73) Assignee: NINGBO USUN PRODUCTS DESIGN CO., LTD., Ningbo (CN)

( * ) Notice: Subject to any disclaimer, the term of this patent is extended or adjusted under 35 U.S.C. 154(b) by 176 days.

(21) Appl. No.: 18/198,833

(22) Filed: May 17, 2023

(65) Prior Publication Data

US 2023/0284802 A1 Sep. 14, 2023

Related U.S. Application Data

(63) Continuation-in-part of application No. PCT/CN2021/135592, filed on Dec. 6, 2021.

(30) Foreign Application Priority Data

Feb. 5, 2021 (CN) ..... 202110160966.1

(51) Int. Cl.
*A47C 7/38* (2006.01)
*A47G 9/10* (2006.01)

(52) U.S. Cl.
CPC ..... *A47C 7/383* (2013.01); *A47G 9/1009* (2013.01)

(58) Field of Classification Search
CPC ..... A47C 7/383; A47G 9/1009
See application file for complete search history.

(56) References Cited

U.S. PATENT DOCUMENTS 3,283,344 A * 11/1966 Blanchard ..... A47G 9/1009 5/639
5,970,546 A * 10/1999 Danis ..... A47C 20/026 5/636
6,305,749 B1 * 10/2001 O'Connor ..... B60N 2/868 5/636
8,898,840 B1 * 12/2014 Majette ..... A47C 7/383 5/643
9,615,682 B1 * 4/2017 Maddocks ..... B60N 2/5664
(Continued)

FOREIGN PATENT DOCUMENTS

CN 209297430 U * 8/2019
CN 212368732 U * 1/2021
(Continued)

*Primary Examiner* — Eric J Kurilla
(74) *Attorney, Agent, or Firm* — MATTHIAS SCHOLL P.C.; Matthias Scholl

(57) ABSTRACT

A travel pillow includes a main body, a rotary frame disposed on the outer side of the main body, and a casing detachably disposed on the outer side of the rotary frame. The rotary frame includes a support arm, a rear support part, and an angle adjustment assembly. The support arm is rotatably connected to the rear support part, and the angle adjustment assembly is disposed between the support arm and the rear support part to adjust an angle between the support arm and the rear support part. The angle adjustment assembly includes a rotating shaft and a damper. The damper sleeves one end of the rotating shaft and includes a first fixing part and an adjustment end; the adjustment end includes a plurality of adjustment sections disposed at equal intervals around the rotating shaft. Each of the adjustment sections includes two adjustment sections.

5 Claims, 11 Drawing Sheets

(56) References Cited

U.S. PATENT DOCUMENTS

| | | | | |
|---|---|---|---|---|
| 11,759,029 | B2 * | 9/2023 | Beeftink | B60N 2/7005 5/655 |
| 2002/0185573 | A1 * | 12/2002 | Bisch | B60N 2/882 248/118 |
| 2003/0135927 | A1 * | 7/2003 | Hsia | A47G 9/1009 5/643 |
| 2004/0217639 | A1 * | 11/2004 | Clough | A47C 7/38 297/391 |
| 2016/0120326 | A1 * | 5/2016 | Belleh | B60N 2/806 297/391 |
| 2017/0071349 | A1 * | 3/2017 | Wong | A47C 7/383 |
| 2020/0060450 | A1 * | 2/2020 | Wong | A47C 27/20 |
| 2023/0284781 | A1 * | 9/2023 | Ge | A61H 99/00 |

FOREIGN PATENT DOCUMENTS

| | | | | |
|---|---|---|---|---|
| DE | 20003970 | U1 * | 7/2000 | A47C 7/383 |
| KR | 101616507 | B1 * | 4/2016 | |

* cited by examiner

TRAVEL PILLOW

CROSS-REFERENCE TO RELATED APPLICATIONS

This application is a continuation-in-part of International Patent Application No. PCT/CN2021/135592 with an international filing date of Dec. 6, 2021, designating the United States, now pending, and further claims foreign priority benefits to Chinese Patent Application No. 202110160966.1 filed Feb. 5, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a travel pillow.

A conventional travel pillow normally includes two arms which cannot be bent to the desired angles or allows only a limited number of bends.

SUMMARY

To solve the aforesaid problems, an objective of the disclosure is to provide a travel pillow, comprising: a main body, a rotary frame disposed on the outer side of the main body, and a casing detachably disposed on the outer side of the rotary frame.

The rotary frame comprises a support arm, a rear support part, and an angle adjustment assembly; the support arm is rotatably connected to the rear support part, and the angle adjustment assembly is disposed between the support arm and the rear support part to adjust an angle between the support arm and the rear support part; the angle adjustment assembly comprises a rotating shaft and a damper; the damper sleeves one end of the rotating shaft; the damper comprises a first fixing part and an adjustment end; the adjustment end comprises a plurality of adjustment sections disposed at equal intervals around the rotating shaft; each of the adjustment sections comprises a first adjustment section and a second adjustment section; the first adjustment section is closer to the first fixing part than the second adjustment section; and the first adjustment section has a greater outer diameter than the second adjustment section; the support arm comprises a first socket ring, and the rear support part comprises a second socket ring; the first socket ring is connected to the support arm and sleeves the rotating shaft; and the second socket ring is connected to the rear support part and sleeves the rotating shaft; and the rotating shaft comprises a second fixing part and a damping part which are disposed on both ends of the rotating shaft, respectively; the damper is detachably disposed around the damping part so as to rotate around the damping part; and the second fixing part comprises an external thread matched with a threaded nut.

The casing is configured to cover and protect the rotary frame, giving an improved visual aesthetic. The rotary frame is used in cooperation with the main body. As the support arm rotates, the main body rotates as well, allowing the user's neck to be propped up at a comfortable angle. The support arm and the rear support part sleeve the rotating shaft; and the rotating shaft is used in conjunction with the damper to arrest the support arm at any position, thus enhancing the user experience.

The plurality of adjustment sections is disposed at equal intervals around the rotating shaft to increase the durability and service life of the damper. The plurality of adjustment sections allows easy replacement of the adjustment end and thus can be matched with different rotating shafts in size. Thus, when the support arm rotates around the rotating shaft, the rotating shaft will not disengage from the rear support.

In a class of this embodiment, the damper further comprises a damping cover comprising an internal thread; and the first fixing part comprises an external thread matched with the internal thread.

The damping cover sleeves the adjustment end; the magnitude of damping is adjusted by tightening or loosening the damping cover on the damper, which allows for easy rotation of the support arm and prevents the second socket ring from sliding off the rotating shaft.

In a class of this embodiment, the second fixing part has an irregular shape; the second socket ring comprises a connection part matched with the second fixing part in shape; and the connection part sleeves the second fixing part.

As the support arm rotates, the rotating shaft is stationary relative to the support arm, thus allowing the support arm to be arrested at any position.

In a class of this embodiment, the second socket ring further comprises a first ring part and a second ring part; the rotating shaft is inserted through the second ring part, the first socket ring, and the second ring part successively, and is fixedly disposed to prevent the first socket ring from sliding off the rotating shaft.

In a class of this embodiment, the travel pillow comprises a filler disposed between the rotary frame and the casing; and the filler comprises silicone.

Silicone is tougher than a foam or cloth material, which facilitates stable connection between the rotary frame and the casing; and the filler has elasticity and thus protects the angle adjustment assembly from being damaged.

The following advantages are associated with the travel pillow of the disclosure:

1. The angle adjustment assembly is configured to adjust the angle between the support arm and the rear support part so as to help a user's neck stay comfortable.
2. The rotating shaft is used in conjunction with the damper to arrest the support arm at any position, thus enhancing the user experience.
3. The plurality of adjustment sections is easy to replace, thus increasing the durability and service life of the damper.
4. The filler comprises silicone of which the hardness makes a more stable and detachable connection between the filler and the casing, and of which the softness enhances the user's experience.

Figure 1:
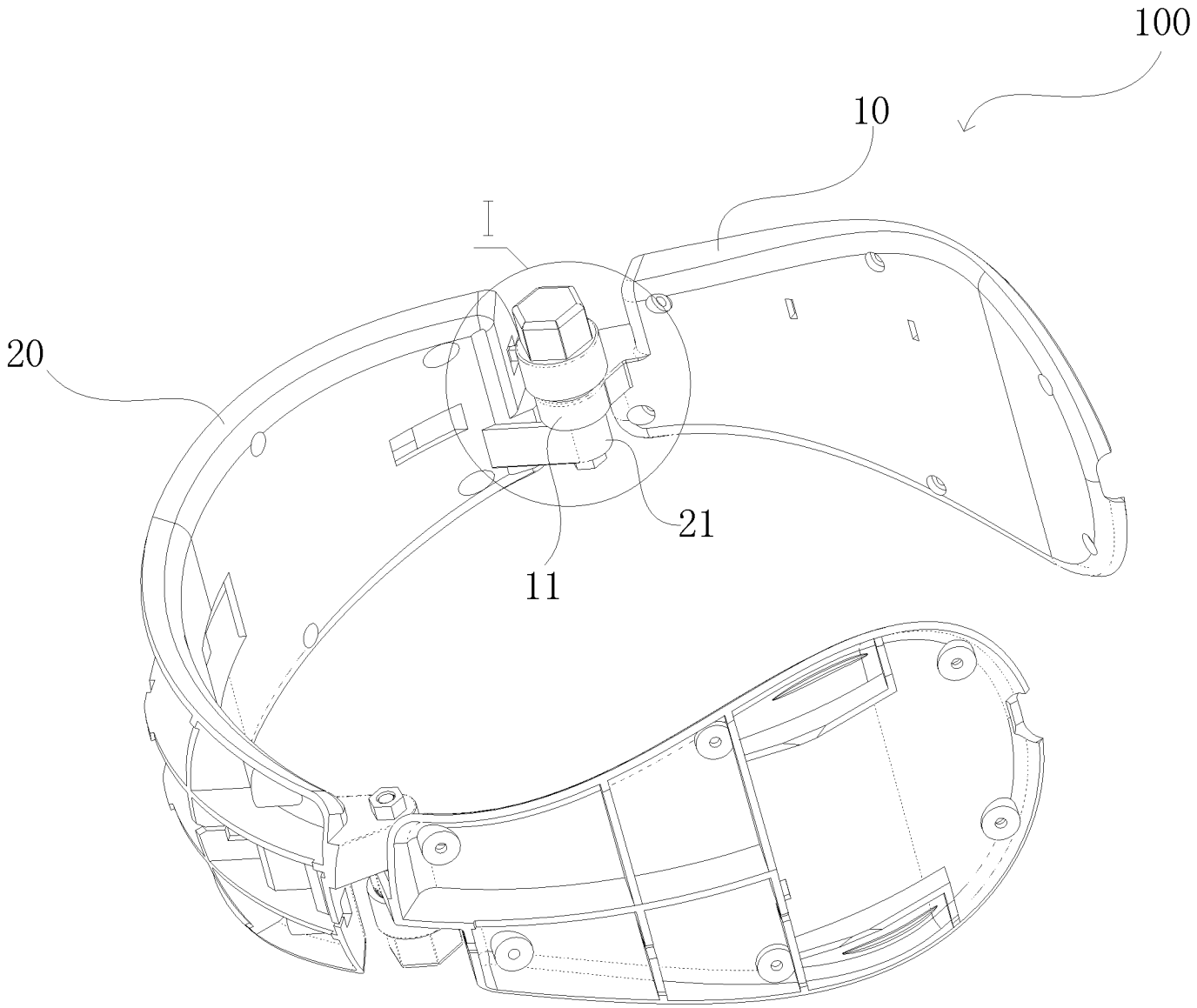
FIG. 1 is a perspective view of a rotary frame according to Example 1 of the disclosure.

In the drawings, the following reference numbers are used: 100. Rotary frame; 10. Support arm; 11. First socket ring; 20. Rear support part; 21. Second socket ring; 21*a*. Connection part; 30. Angle adjustment assembly; 40. Rotating shaft; 41. Second fixing part; 42. Damping part; 41*a*. Threaded end; 41*b*. Threaded nut; 50. Damper; 51. First fixing part; 51*a*. External thread ;52. Adjustment end; 53. Adjustment section; 53*a*. First adjustment section; 53*b*. Second adjustment section; 54. Damping cover; 54*a*. Internal thread. 200. Travel pillow; 210. Main body; 211. Space; 220. Casing; 221. First casing; 222. Second casing; 230. Filler; and 231. Tab.

DETAILED DESCRIPTION

To further illustrate the disclosure, embodiments detailing a travel pillow are described below. It should be noted that the following embodiments are intended to describe and not to limit the disclosure.

Example 1

Figure 2:
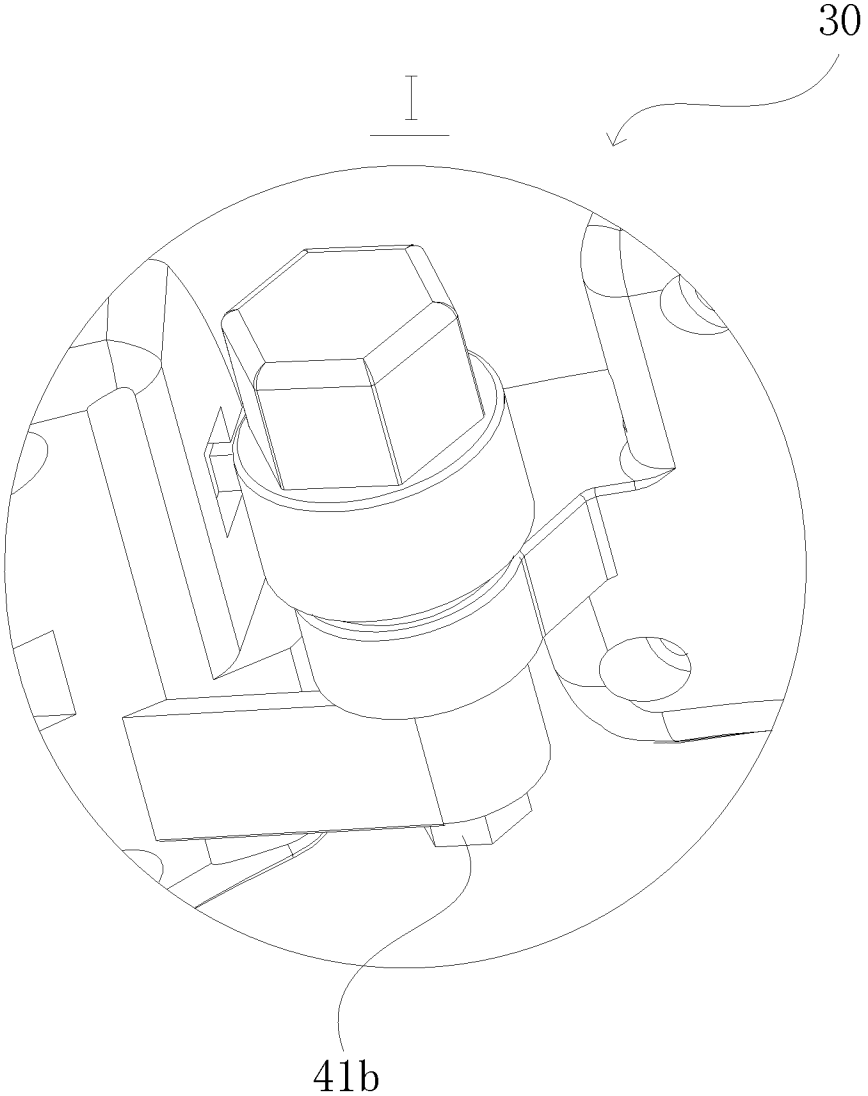
FIG. 2 is a local enlarged view of part I in FIG. 1.

As shown in FIGS. 1-2, a rotary frame 100 comprises a support arm 10, a rear support part 20, and an angle adjustment assembly 30. The support arm 10 is rotatably connected to the rear support part 20, and the angle adjustment assembly 30 is disposed between the support arm 10 and the rear support part 20.

Figure 3:
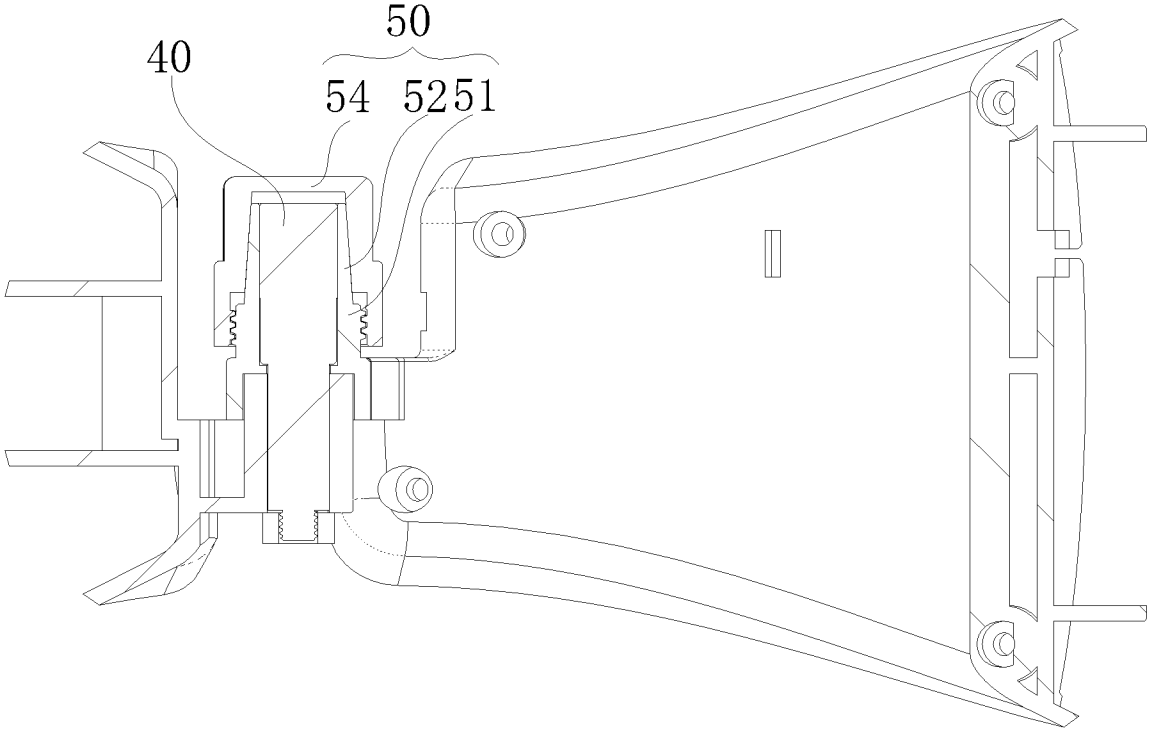
FIG. 3 is a cross-sectional view of an angle adjustment assembly according to one example of the disclosure.
Figure 4:
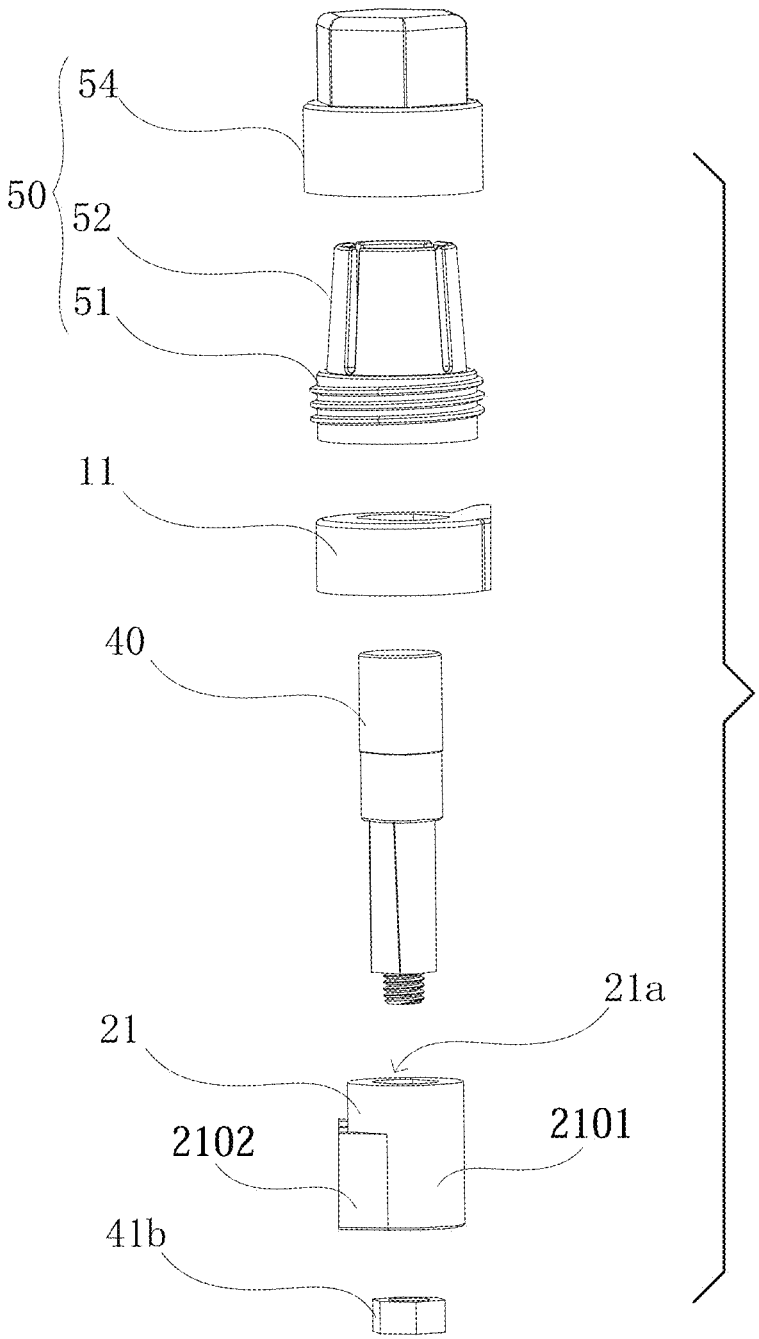
FIG. 4 is an exploded view of an angle adjustment assembly according to one example of the disclosure.

The support arm 10 comprises a first socket ring 1, and the rear support part 20 comprises a second socket ring 21. As shown in FIGS. 3-4, the angle adjustment assembly 30 comprises a rotating shaft 40 and a damper 50 sleeving the rotating shaft 40. The first socket ring 11 is used in conjunction with the damper 50, and the second socket ring 21 is used in conjunction with the rotating shaft 40. An angle between the support arm 10 and the rear support part 20 is adjusted by the angle adjustment assembly.

Figure 5:
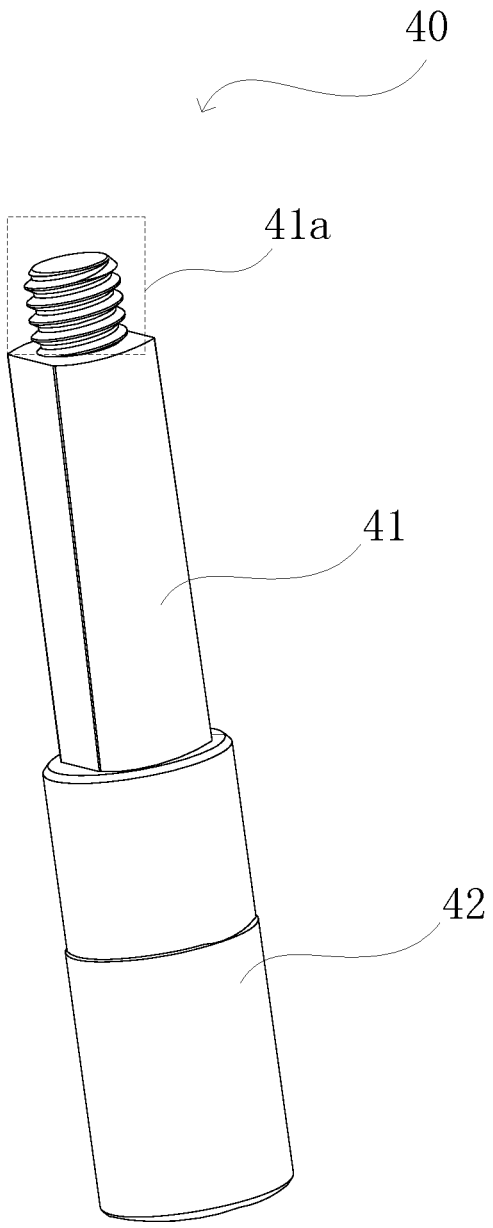
FIG. 5 is a perspective view of a rotating shaft in FIG. 3.

In certain examples, as shown in FIG. 5, the rotating shaft 40 comprises a second fixing part 41 and a damping part 42. The second fixing part 41 comprises a threaded end 41*a* away from the damping part 42. Referring to FIG. 2, the second fixing part 41 further comprises a threaded end 41*a* matched with a threaded nut 41*b*; the second fixing part 41 has an irregular shape, such as a quadrangular prism (as shown in FIG. 5) or other prism shape; optionally, the second fixing part 41 is in the shape of a cylinder which is provided with edges or slots. The second socket ring 21 comprises a connection part 21*a* matched with the second fixing part 41 in shape. The second fixing part 41 is disposed on the connection part to ensure that the second fixing part 41 and the second socket ring cannot rotate. The threaded nut 41*b* is matched with the threaded end 41*a* so as to prevent the second socket ring 21 from sliding off the rotating shaft 40. As shown in FIGS. 3-4, the damper 50 and the first socket ring 11 are detachably disposed on the damping part 42. As the support arm 10 rotates, the first socket ring 11 and the damper 50 rotate as well so as to arrest the support arm at any position.

Figure 6:
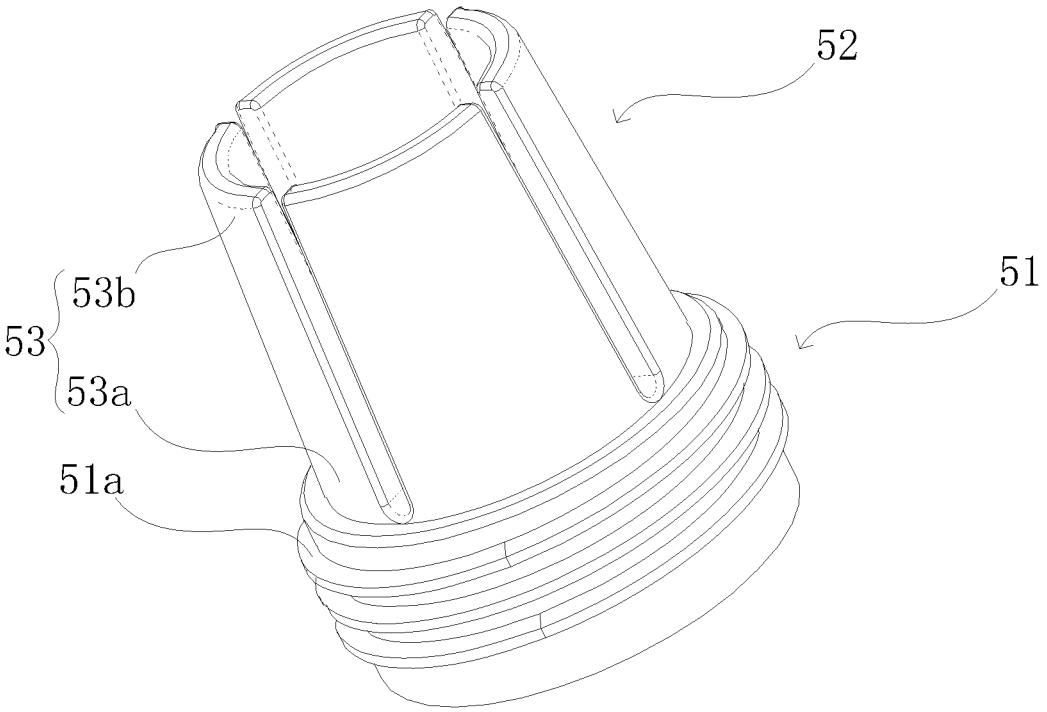
FIG. 6 is a perspective view of a damper in FIG. 3.

In certain examples, as shown in FIGS. 6, the damper 50 comprises a first fixing part 51 and an adjustment end 52 connected to the first fixing part 51. The first fixing part 51 comprises an external thread 51*a*. The first fixing part 51 comprises a distal end away from the adjustment end 52, and the first socket ring 11 is disposed on the distal end. The adjustment end 52 comprises a plurality of adjustment sections 53 disposed at equal intervals around the damping part 42. Each of the plurality of adjustment sections 53 comprises a first adjustment section 53*a* and a second adjustment section 53*b* connected to the first adjustment section 53*a*. The first fixing part 51 comprises a proximal end connected to the first adjustment section 53*a*. The first adjustment section 53*a* has a greater outer diameter than the second adjustment section 53*b*. The adjustment end 52 sleeves the rotating shaft 40. As the support arm 10 rotates, the adjustment end 52 can arrest the support arm 10 in any position. The plurality of adjustment sections 53 is easy to replace, thus increasing the durability and service life of the damper 50.

Preferably, the second socket ring 21 further comprises a first ring part 2101 and a second ring part 2102. A space is formed between the first ring part and the second ring part. The first socket ring 11 is inserted through the damper 50 into the space. The rotating shaft 40 comprises two second fixing parts 41 which are inserted through the first ring part, the first socket ring 11, and the second ring part successively, to improve stability of the rotary frame 100.

Figure 7:
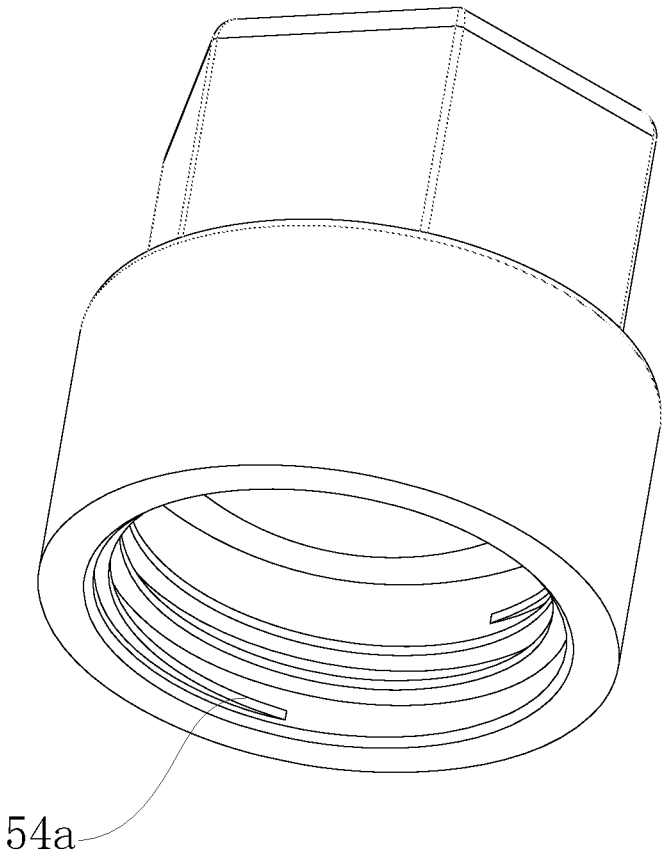
FIG. 7 is a perspective view of a damping cover in FIG. 3.

In certain examples, as shown in FIG. 7, the damper 50 further comprises a damping cover 54 comprising an internal thread 54*a*. The external thread 51*a* is matched with the internal thread 54*a* to ensure the first fixing part 51 is connected to the damping cover 54. The magnitude of damping is adjusted by tightening or loosening the damping cover 54 on the first fixing part 51.

As the support arm 10 rotates, the first socket ring 10 rotates as well, causing the damper 50 to rotate around the rotating shaft 40. Thus, the angle between the support arm 10 and the rear support part 20 is adjusted.

In certain examples, when the damping cover 54 is tightened by a user, the magnitude of damping increases, thus increasing the force required to rotate the support arm 10.

Example 2

Figure 8:
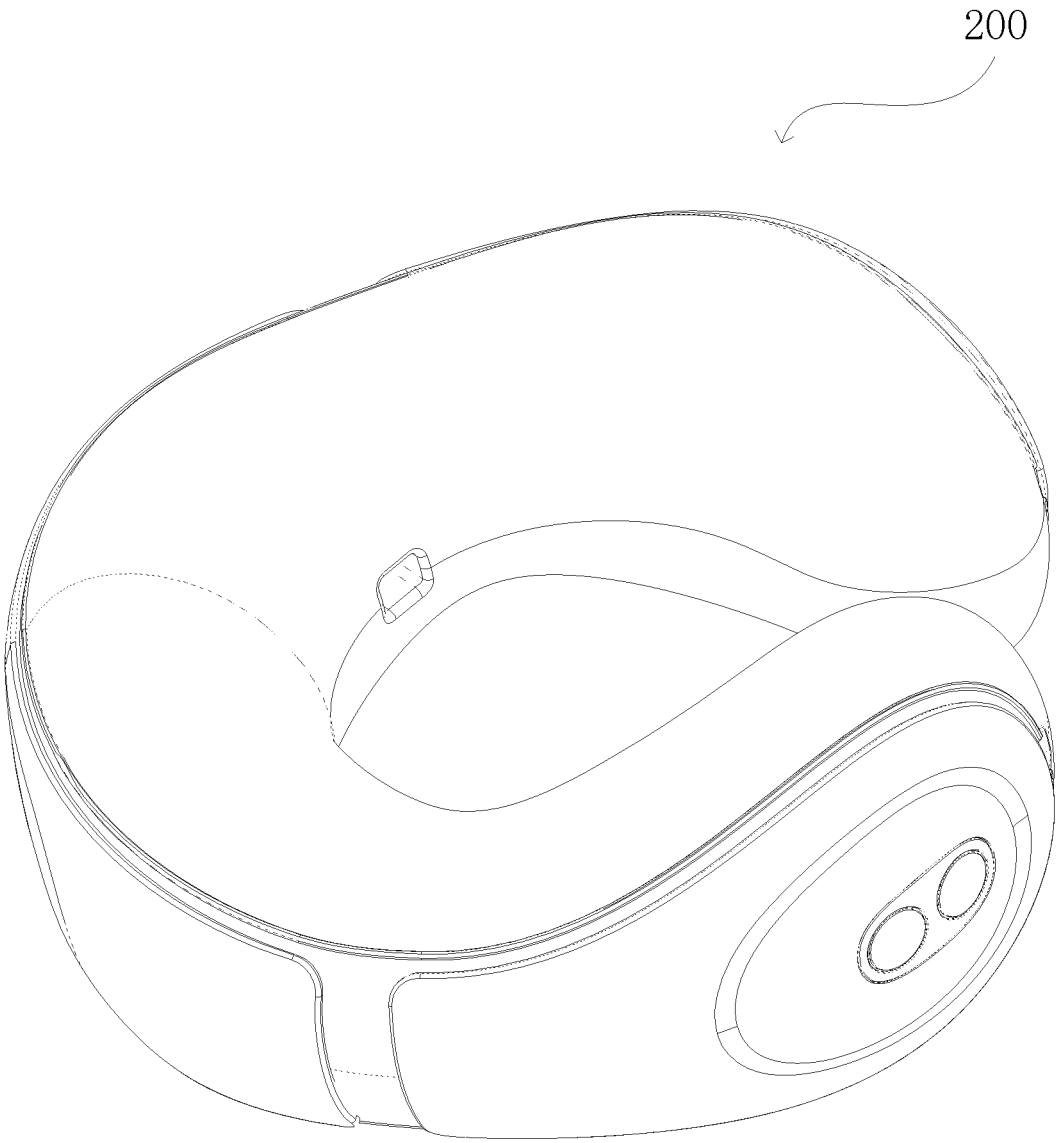
FIG. 8 is a perspective view of a travel pillow according to Example 2 of the disclosure.

FIG. 8 is a perspective view of a travel pillow according to Example 2 of the disclosure. The travel pillow is U-shaped and comprises a notch for receiving a user's neck or head. The travel pillow provides a natural resting position for the user's neck or head, improving neck pain and upper back pain.

Figure 9:
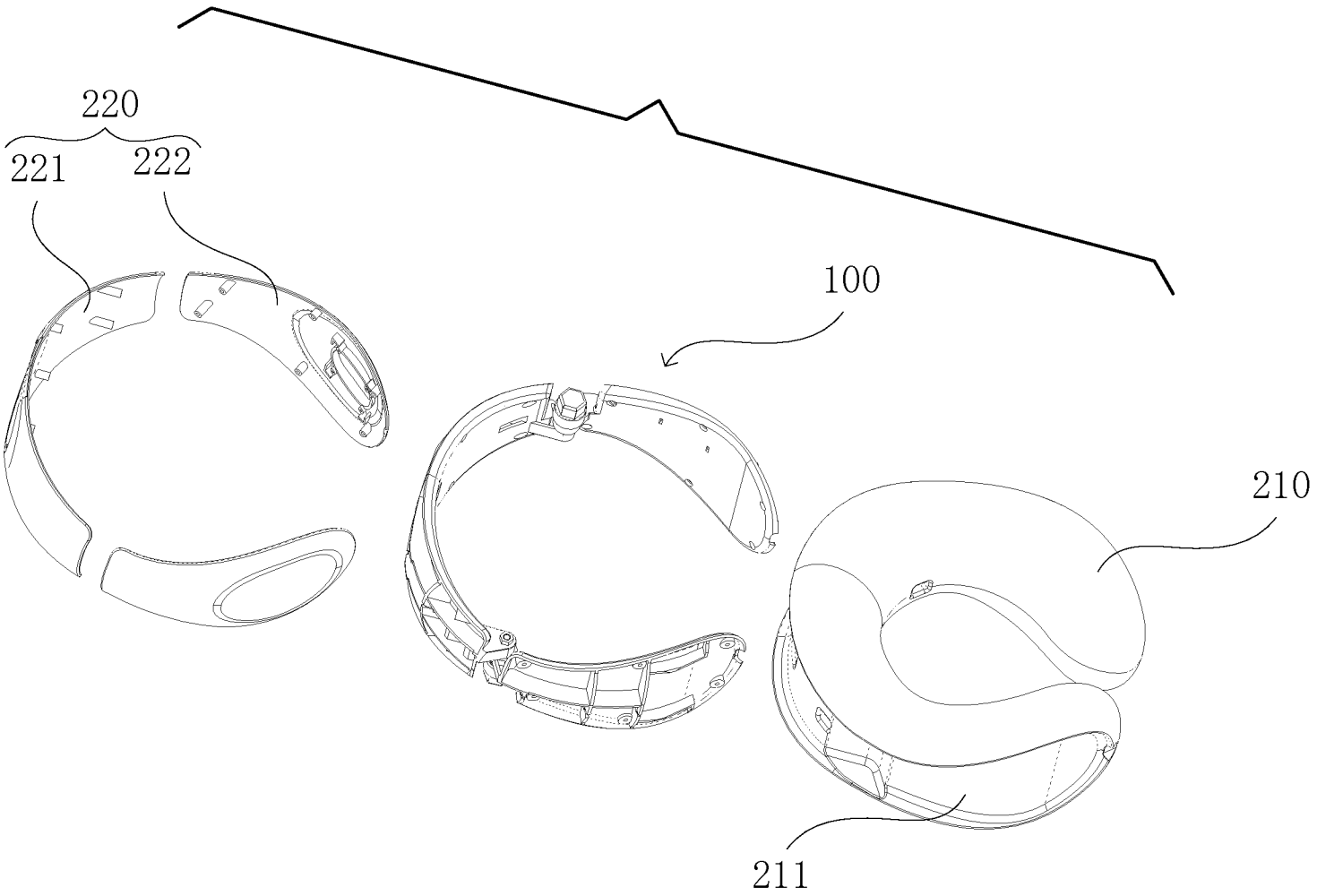
FIG. 9 is an exploded view of a travel pillow in FIG. 8.

As shown in FIG. 9, the travel pillow 200 comprises a main body 210, a casing 220, and the rotary frame 100 as described in Example 1. The outer wall of the main body 210 comprises a space 211 matched with the rotary frame 100 in shape. The rotary frame 100 is disposed in the space 211 so as to be detachably connected to the main body 210, which allows easy cleaning and replacement of the main body 210. The casing 220 is detachably disposed on the outer side of the rotary frame 100, which allows easy replacement of the rotary frame 100 and the casing 220, thus reducing cost.

Preferably, the rotary frame 100 is detachably disposed on the main body 210 using connection means, such as zippers, buttons, clamps, etc. The detachable connection means allow for easy cleaning, attachment and detachment of the main body 210 and the rotary frame 100.

The casing 220 comprises a first casing 221 and a second casing 222. The casing 220 is configured to cover the outer side of the rotary frame 100 and gives an improved visual aesthetic. The first casing 221 is configured to protect the rear support part 20 from being damaged. The second casing 222 is configured to protect the support arm 10 from internal damage and thus achieve improved service life.

The rotary frame 100 is used in cooperation with the main body 210. As the support arm 10 rotates, the main body 210 rotates as well, allowing the user's neck to be propped up at a comfortable angle. The angle adjustment decreases the resistive force produced by the rotation of the support arm and improves the service life of the travel pillow 200.

Figure 10:
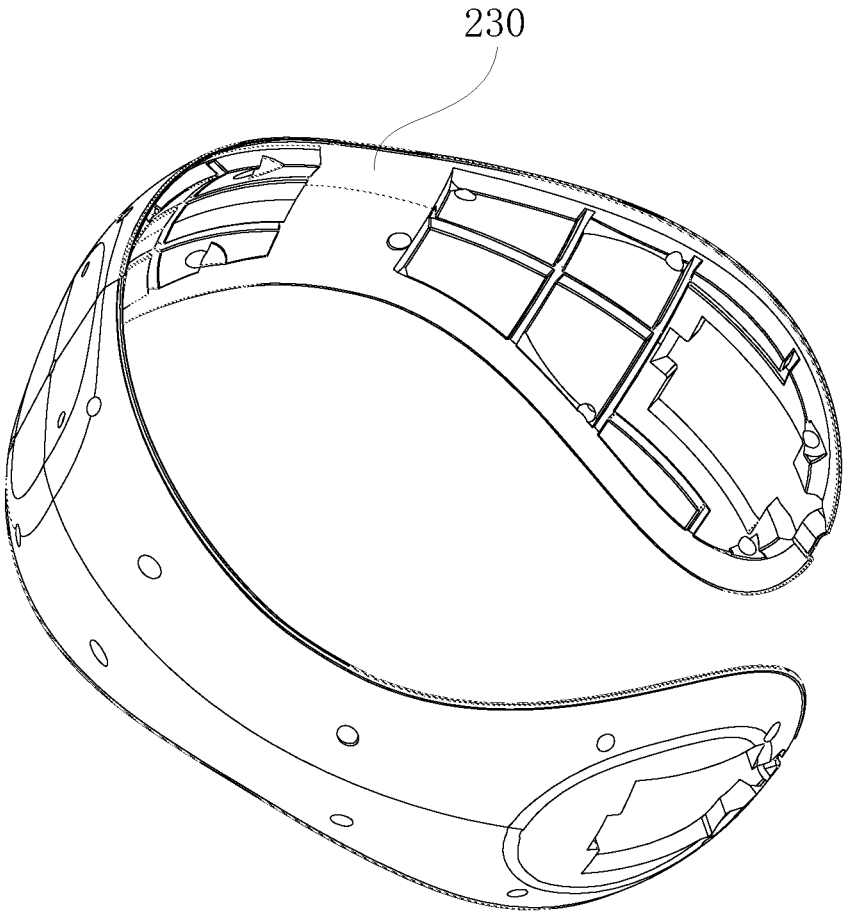
FIG. 10 is a perspective view of a filler according to one example of the disclosure.
Figure 11:
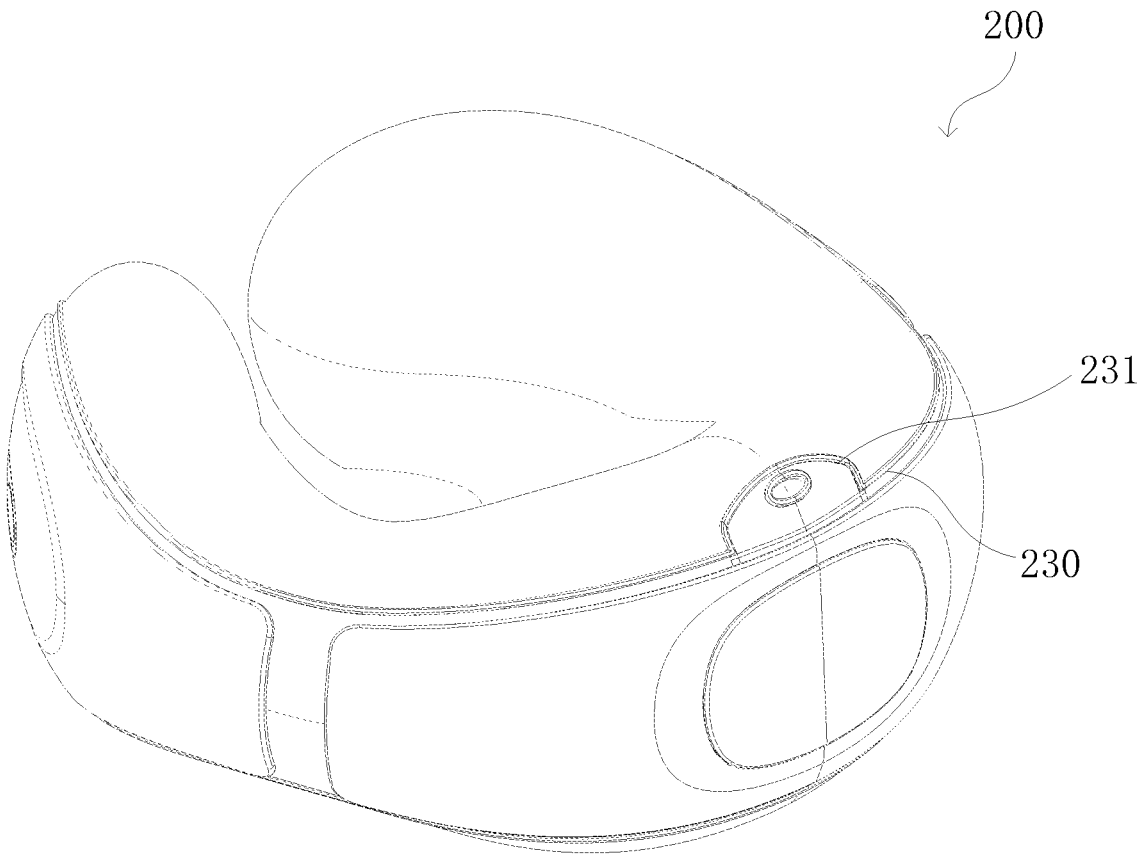
FIG. 11 is a perspective view of a travel pillow with a filler according to one example of the disclosure.

Preferably, as shown in FIGS. 10 and 11, the travel pillow 200 comprises a filler 230 disposed between the rotary frame 100 and the casing 220. The filler 230 comprises silicone or rubber for improving user's comfort. The silicone or rubber is tougher than a foam or cloth material, which facilitates stable connection between the rotary frame 100 and the casing 220. The casing 220 is further configured to protect the filler 230 from being damaged. The filler 230 has elasticity and thus protects the angle adjustment assembly 30 from being damaged.

The filler 230 further comprises a tab 231, comprising a hang hole 231. When the user is wrapped into the travel pillow 200, the tab 231 hang down to cover the zipper; when the travel pillow 200 is not in use by the user, the tab 231 allows the travel pillow to be placed on the hook.

The tab 231 and the filler 230 are made of the same elastic material, such as silicone.

The travel pillow 200 further comprises a pressure part (not shown), comprising a pressure surface (not shown). The first casing 221 comprises a distal surface away from the rotary frame. The pressure part is disposed on the distal end of the first casing 221, and the pressure surface is a flat surface away from the rotary frame.

The pressure surface is positioned against an object to ensure the user's neck is propped up at a comfortable angle. When the pressure surface is a curved surface, the travel pillow 200 may slip and slide around, thus diminishing the user experience.

Preferably, the pressure part is in the shape of an ellipse, a circle, or a polygon. The distal end of the first casing 221 comprises a pressure area (not shown) in which the pressure part is fixedly disposed. Preferably, the pressure part and the pressure area are in the shape of an ellipse. The ellipse has more area than the circle and thus is easier to be connected to the first casing 221. The ellipse has more rounded corners than the polygon and thus prevents a sharp edge from damaging to the body or other objects. Optionally, the pressure part and the pressure area are in the shape of a square with rounded corners without departing from the scope and spirit of the disclosure.

Preferably, the pressure part further comprises a fixing member (not shown) connected to any side of the pressure part. For examples, the travel pillow 200 comprises a top part and a bottom part; the top part props up the user's neck, and the bottom part is position against the user's shoulder. The pressure part comprises a first end near the top part of the travel pillow, and a second end near the bottom part of the travel pillow. The fixing member is connected to the first end, and/or the second end, and/or both ends of the pressure part.

The first casing 221 further comprises a slot (not shown) extending at least partially on one side of the pressure area. The slot is used in cooperation with the fixing part. For examples, the fixing part is disposed on the first end, the second end, or both ends of the pressure part. The slot is disposed on the first end, the second end, or both ends of the pressure part. The slot is used in cooperation with the fixing part to improve the connection between the pressure part and the pressure area. The fixing member can be removed by hand, which allows for easy detachment of the pressure part and the pressure area.

It will be obvious to co those skilled in the art that changes and modifications may be made, and therefore, the aim in the appended claims is to cover all such changes and modifications.

What is claimed is:

1. A travel pillow, comprising:

a main body;

a rotary frame disposed on an outer side of the main body; and a casing detachably disposed on an outer side of the rotary frame;

wherein:

the rotary frame comprises a support arm, a rear support part, and an angle adjustment assembly; the support arm is rotatably connected to the rear support part, and the angle adjustment assembly is disposed between the support arm and the rear support part to adjust an angle between the support arm and the rear support part;

the angle adjustment assembly comprises a rotating shaft and a damper; the damper sleeves one end of the rotating shaft; the damper comprises a first fixing part and an adjustment end; the adjustment end comprises a plurality of adjustment sections disposed at equal intervals around the rotating shaft; each of the adjustment sections comprises a first adjustment section and a second adjustment section; the first adjustment section is closer to the first fixing part than the second adjustment section; and the first adjustment section has a greater outer diameter than the second adjustment section;

the support arm comprises a first socket ring, and the rear support part comprises a second socket ring; the first socket ring is connected to the support arm and sleeves the rotating shaft; and the second socket ring is connected to the rear support part and sleeves the rotating shaft; and the rotating shaft comprises a second fixing part and a damping part which are disposed on both ends of the rotating shaft, respectively; the damper is detachably disposed around the damping part so as to rotate around the damping part; and the second fixing part comprises an external thread matched with a threaded nut.

2. The travel pillow of claim 1, wherein the damper further comprises a damping cover comprising an internal thread; and the first fixing part comprises an external thread matched with the internal thread.

3. The travel pillow of claim 1, wherein the second fixing part has an irregular shape; the second socket ring comprises a connection part matched with the second fixing part in shape; and the connection part sleeves the second fixing part.

4. The travel pillow of claim 1, wherein the second socket ring further comprises a first ring part and a second ring part; the rotating shaft is inserted through the second ring part, the first socket ring, and the second ring part successively, and is fixedly disposed to prevent the first socket ring from sliding off the rotating shaft.

5. The travel pillow of claim 1, wherein the travel pillow comprises a filler disposed between the rotary frame and the casing; and the filler comprises silicone.

* * * * *